United States Patent [19]

McComas

[11] Patent Number: 5,019,163

[45] Date of Patent: May 28, 1991

[54] CORROSION/WEAR-RESISTANT METAL ALLOY COATING COMPOSITIONS

[76] Inventor: C. Edward McComas, 2780 Firestation Rd., Martinsville, Ind. 46151

[21] Appl. No.: 335,807

[22] Filed: Apr. 10, 1989

Related U.S. Application Data

[60] Division of Ser. No. 939,035, Dec. 5, 1986, Pat. No. 4,833,041, which is a continuation-in-part of Ser. No. 869,037, May 30, 1986, abandoned.

[51] Int. Cl.[5] ..... C23C 18/34

[52] U.S. Cl. ..... 106/1.22; 106/1.27

[58] Field of Search ..... 106/1.22, 1.27; 420/441; 428/610, 678, 679, 680

[56] References Cited

U.S. PATENT DOCUMENTS

| | | | |
|---|---|---|---|
| 2,990,296 | 6/1961 | Hoke | 428/679 |
| 3,045,334 | 7/1962 | Berzins | 420/441 |
| 3,062,666 | 11/1962 | McLeod . | |
| 3,208,353 | 8/1966 | Melillo | 428/680 |
| 3,295,999 | 1/1967 | Klein et al. . | |
| 3,338,726 | 8/1967 | Berzins . | |
| 3,378,400 | 4/1968 | Sickles . | |
| 3,432,338 | 3/1969 | Sickles . | |
| 3,562,000 | 2/1971 | Parker . | |
| 3,674,447 | 7/1972 | Bellis . | |
| 3,753,667 | 8/1973 | Metzger et al. . | |
| 4,621,026 | 11/1986 | Robinson | 148/125 |

FOREIGN PATENT DOCUMENTS

| | | | |
|---|---|---|---|
| 1321669 | 6/1973 | United Kingdom | 420/680 |

OTHER PUBLICATIONS

Brenner et al., "Deposition of Nickel and Cobalt by Chemical Reduction", Int. Research National Bureau of Standards vol. 39, pp. 385–395 Nov. (1947).

Harold Narcus, An Introduction to Chemical Nickel Plating with Sodium Borohydride or Amine Boranes as Reducing Agent, *Plating*, Apr. 1967, pp. 380–381.

G. O. Malory, The Electroless Nickel–Boron Plating Bath: Effects of Variables on Deposit Properties, *Plating*, Apr., 1971, pp. 319–326.

Von K. Lang, Ein Neues Verfahren Zur Stromlosen Vernickelung, Metalloberflache, Aug. 1965, pp. 257–262.

"The Chemical Nickel Plating with Sodium Borohydride or Amine Boranes: The Nibodur Process", K. Lang, *Electropolating and Metal Finishing*, Mar. 1966, pp. 86–91 and 96.

"Untersuchungen zur Abscheidung von Nickel–Bor–Legierungsschichten aus Modifizierten Elektrolyten", (Deposition of Nickel–Boron Alloy Layers from Modified Electrolytes), *Metall*, vol. 39, pp. 238–244, Mar. 1985, K. Stallman & H. Speckhardt.

*Primary Examiner*—Karl Group

*Attorney, Agent, or Firm*—Barnes & Thornburg

[57] ABSTRACT

Corrosion and wear resistant metallic compositions containing nickel, cobalt, boron and thallium and articles coated therewith are described. Preferred electroless coatings contain nickel and cobalt in a ratio of about 45:1 to about 4:1 and are deposited as hard, amorphous alloy nodules of high nickel content dispersed or rooted in a sofer alloy of high cobalt content. The coatings are preferably deposited on catalytically active substrates from an electroless coating bath containing nickel ions, cobalt ions, thallium ions, metal ion complexing agents and a borohydride reducing agent at pH about 12 to about 14. With post-coating heat treatment coated surfaces exhibit hardness levels as high as about 1300 Knoop.

5 Claims, 1 Drawing Sheet

CORROSION/WEAR-RESISTANT METAL ALLOY COATING COMPOSITIONS

This is a division of U.S. application Ser. No. 06/939,035 filed Dec. 5, 1986, now U.S. Pat. No. 4,833,041, which application was a continuation-in-part of U.S. application Ser. No. 869,037, filed May 30, 1986, abandoned.

BACKGROUND OF THE INVENTION

This invention relates to novel metal coatings which exhibit exceptional resistance to corrosion and wear. More particularly this invention relates to metal coatings containing nickel, cobalt, boron and thallium and to the reductive deposition of said coatings on the surfaces of substrate articles from aqueous solutions at high pH.

The plating or deposition of metal alloys by chemical or electrochemical reduction of metal ions on the surface of an article to modify its surface characteristics for both decorative and functional purposes is well known in the art. Of particular commercial significance is the deposition of metal/metal alloy coatings on both metal and activated non-metal substrates to enhance surface hardness and resistance to corrosion and wear. Nickel-boron and cobalt-boron alloy coatings are recognized in the art for their hardness and associated wear-resistance. The patent literature reflects an ongoing research and development effort in the area of nickel-boron/-cobalt-boron coatings with the goal of producing still harder, more corrosion resistance coatings. See, for example, U.S. Pat. Nos. 3,738,849; 3,045,334; 3,674,447; and 2,726,710. Bellis U.S. Pat. No. 3,674,447 describes nickel-boron and cobalt-boron coatings of improved hardness containing controlled amounts of thallium dispersed throughout the coatings. It has now been discovered that coatings containing both nickel and cobalt in combination with boron and thallium exhibit marked advantages over the thallium-containing nickel/boron or cobalt/boron coatings described by Bellis. Metal alloy coatings in accordance with the present invention containing boron, thallium and nickel and cobalt are more wear resistant and remarkably more corrosion resistant than those described in the prior art.

Electroless coatings containing both nickel and cobalt are described in U.S. Pat. Nos. 3,378,400 and 3,342,338. However in each of those patents a hypophosphite, and not a boron-containing reducing agent was used to deposit said coatings. Similarly U.S. Pat. No. 3,562,000 exemplifies deposition of a metal coating from a bath containing both cobalt chloride and nickel chloride using sodium hypophosphite. Although it is disclosed in that patent that other suitable reducing agents, including borohydrides, could be used in the numbered examples in place of the preferred hypophosphite, there is provided no description of the improved coatings in accordance with this invention.

It is therefore a general object of this invention is to provide improved metal coatings containing both nickel and cobalt, boron and thallium.

A further object of this invention is to provide an article of manufacture coated on at least a portion of its surface with a hard, ductile, wear and corrosion resistant metal coating comprising nickel and cobalt, boron and thallium.

Still a further object of this invention is to provide a heterogeneous electroless metal alloy coating containing both nickel and cobalt, boron and thallium having a metal concentration gradient in thickness cross-section.

Another object of this invention is to provide an electroless metal alloy coating presenting a corrosion and wear resistant surface comprising amorphous nodular deposits of nickel, cobalt, boron and thallium.

Yet another object of this invention is to provide coating baths from which a hard, ductile, wear and corrosion resistant coating can be deposited on at least a portion of the surface of a metal or activated non-metal substrate.

Those and other objects of this invention will be apparent to those skilled in the art from the following summary and detailed description of the invention.

SUMMARY OF THE INVENTION

According to the present invention there is provided a novel metal alloy composition containing both nickel and cobalt, boron and thallium. The alloy composition is particularly useful for deposition on a surface of an article of manufacture, which is subject to exposure to corrosive conditions or one subject to sliding or rubbing contact with another surface under unusual wearing and bearing pressures. The metal alloy coating composition of the present invention comprises about 67.5 to about 96.5 weight percent nickel, about 2 to about 15 weight percent cobalt, about 0.5 to about 10 weight percent boron and about 1 to about 8 percent thallium. The weight ratio of nickel and cobalt in the bulk coating is about 45:1 to about 4:1, more preferably about 25:1 to about 5:1, respectively. It is remarkably hard, yet ductile, and is highly corrosion and wear resistant.

Both physical and chemical analysis of preferred electroless coatings of this invention reveals significant heterogeneity in thickness cross-section, the coatings comprising hard, amorphous alloy micro-nodules of high nickel content dispersed or "rooted" in a softer alloy matrix of high cobalt content. The weight ratio of nickel and cobalt in the micro-nodules of preferred coatings in accordance with this invention is about 15:1 to about 45:1, respectively.

The present coating is preferably applied to a substrate electrolessly by contacting the substrate with a coating bath containing nickel ions, cobalt ions, thallium ions, a metal ion complexing agent, and a borohydride reducing agent at pH about 12 to about 14 and at an elevated temperature of about 180 to about 210° F. However, the same baths used for electroless coating in accordance with a preferred embodiment of this invention can be used at ambient temperature for deposition of the present composition in an electrochemical cell.

THE DRAWINGS

DETAILED DESCRIPTION OF THE INVENTION

Figure 1:
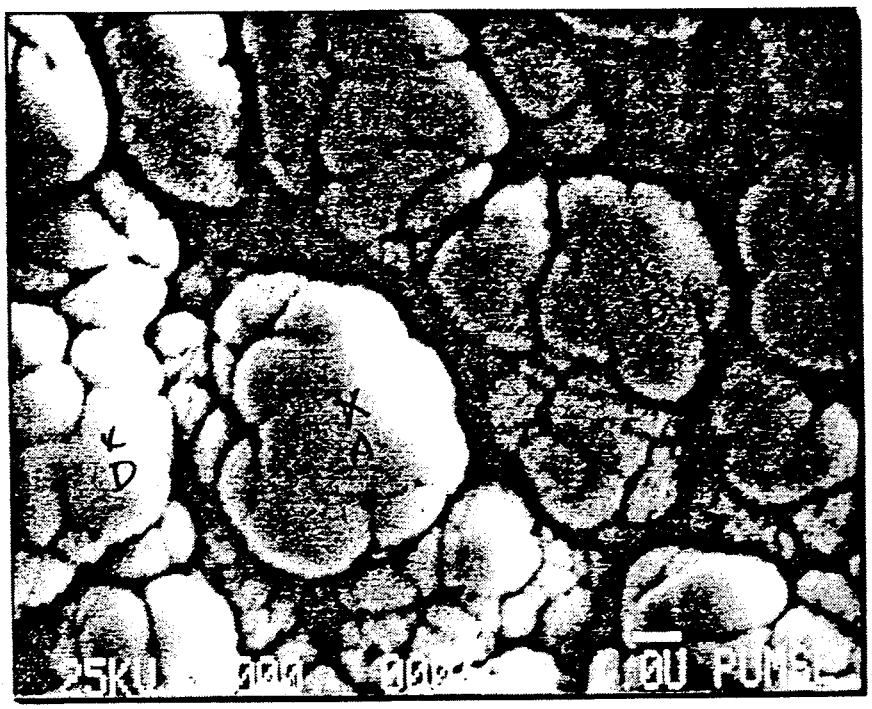
FIG. 1 is an electron photomicrograph of the outer corrosion and wear resistant surface of an electroless coating of this invention.

An article of manufacture in accordance with this invention is coated on at least a portion of its surface with a hard, ductile, wear and corrosion resistant metallic coating comprising about 67.5 to about 96.5 weight percent nickel, about 2 to about 15 weight percent cobalt, about 0.5 to about 10 weight percent boron and about 1 to about 8 percent thallium.

Deposition of the metallic coating on suitable substrates can be accomplished by contacting said substrates with a plating bath comprising an aqueous alkaline (pH about 12 to about 14) solution of nickel, cobalt and thallium salts, a metal ion complexing agent to maintain the metal ions in solution and a borohydride reducing agent.

Suitable substrates are those with so-called catalytically active surfaces including those composed of nickel, cobalt, iron, steel, aluminum, zinc, palladium, platinum, copper, brass, chromium, tungsten, titanium, tin, silver carbon, graphite and alloys thereof. Those materials function catalytically to cause a reduction of the metal ions in the plating bath by the borohydride and thereby result in deposition of the metal alloy on the surface of the substrate in contact with the plating bath. Non-metallic substrates such as glass, ceramics and plastics are in general, non-catalytic materials; however, such substances can be sensitized to be catalytically active by producing a film of one of the catalytic materials on its surface. This can be accomplished by a variety of techniques known to those skilled in the art. One preferred procedure involves dipping articles of glass, ceramic, or plastic in a solution of stannous chloride and then contacting the treated surface with a solution of palladium chloride. A thin layer of palladium is thereby reduced on the treated surface. The article can then be plated or coated with the metallic composition in accordance with this invention by contact with a coating bath as detailed below. It is to be noted that magnesium, tungsten carbide and some plastics have exhibited some resistance to deposition of the present coatings.

A coating bath for deposition of the present coatings comprises (1) nickel ions, cobalt ions, and thallium ions in the amounts indicated, expressed as moles per gallon of coating bath: nickel ions, about 0.4 to about 0.9; cobalt ions, about 0.1 to about 0.4; and thallium ions, about $4\times10^{-5}$ to about $8\times10^{-4}$;

(2) chemical means for adjusting the pH of the bath to between about 12 and about 14;

(3) a metal ion complexing agent in an amount sufficient to inhibit precipitation of said ions from the highly alkaline coating bath; and (4) about 0.025 to about 0.1 moles per gallon of coating bath of a borohydride reducing agent.

The borohydride reducing agent can be selected from among the known borohydrides having a good degree of water solubility and stability in aqueous solutions. Sodium and potassium borohydrides are preferred. In addition, substituted borohydrides in which not more than three of the hydrogen atoms of the borohydride ion have been replaced can be utilized. Sodium trimethoxyborohydride [$NaB(OCH_3)_3H$] is illustrative of that type of compound. Sodium cyanoborohydride has been found to stabilize electroless coating baths utilizing other borohydride reducing agents (U.S. Pat. No. 3,738,849).

The coating bath is prepared to have a pH of about 12 to about 14. Best results have been observed when the pH of the bath is maintained during the coating process within that range and more preferably at about pH 13.5. Adjustment of bath pH can be accomplished by addition of any of a wide variety of alkaline salts or solutions thereof. Preferred chemical means for establishing and maintaining bath pH are the alkali metal hydroxides, particularly sodium and potassium hydroxide, and ammonium hydroxide. Ammonium hydroxide offers an additional advantage in that the ammonium ion can function to assist metal ion complexation in the coating bath.

Due to the high alkalinity of the coating bath, a metal ion complexing or sequestering agent is required in the bath to prevent precipitation of the nickel and cobalt hydroxides or other basic salts. Importantly, too, the metal ion complexing agent functions to lower metal ion reactivity; the complexed or sequestered metal ions have minimal reactity with the borohydride ions in the bulk solution but do react at the catalytic surfaces of substrates in contact with the solution. The term catalytic surface refers to the surface any article composed of the aforementioned catalytic materials or to the surface of a non-catalytic material which has been sensitized by application of a film of said catalytic materials on its surface.

The complexing or sequestering agents suitable for use in this invention include ammonia and organic complex-forming agents containing one or more of the following functional groups: primary amino, secondary amino, tertiary amino, immino, carboxy and hydroxy. Many metal ion complexing agents are known in the art. Preferred complexing agents are ethylene diamine, diethylene triamine, triethylene tetramine, the organic acids, oxalic acid, citric acid, tartaric acid and ethylene diamine tetraacetic acid, and the water soluble salts thereof. Most preferred for use in the present coating bath are ethylene diamine, the water soluble salts of tartaric acid, ammonia and combinations thereof.

About 2 to about 8 moles of complexing agent are used per gallon of coating bath. Best results have been obtained when about 3 to about 5 moles of complexing or sequestering agent is used for each gallon of coating bath.

The nickel, cobalt and thallium ions in the coating bath are provided by the addition to the bath of the respective water soluble nickel, cobalt and thallium salts. Any salts of those metals having an anion component which is not antagonistic to the subject coating process is suitable. For example salts of oxidizing acid such as chlorate salts are not desirable since they will react with the borohydride reducing agent in the bath. Cobalt, nickel, and thallium chlorides, sulfates, formates, acetates, and other salts whose anions are substantially inert with respect to the other ingredients in the alkaline coating bath are satisfactory.

The coating bath is typically prepared by forming an aqueous solution of the appropriate amounts of nickel and cobalt salts, adding the complexing agent(s), adjusting the pH to about 12 to about 14, heating to about 195° F., filtering and finally, immediately before introducing the substrate into the bath, adding the required amounts of thallium salt and sodium borohydride (typically in aqueous alkaline solution).

The article to be coated or plated using a bath in accordance with this invention is prepared by mechanical cleaning, degreasing, anode-alkaline cleaning, and finally pickling in an acid bath in accordance with the standard practice in the metal-plating art. The substrate can be masked if necessary to allow deposition of the metal alloy coating only on selected surfaces. Although the present coatings in general exhibit excellent adhesion to properly prepared substrate surfaces, in instances where coating adhesion is critical or where some adhesion problems are experienced, coating-adhesion can often be enhanced by depositing a nickel strike electrochemically on the substrate surface prior to applying the present coating.

The cleaned or otherwise surface-prepared article is immersed in the hot (about 180 to about 210° F.) coating bath to initiate the coating process. The process is continued until deposition of the coating has progressed to the desired thickness or until the metal ions are depleted from solution. Deposition rates vary under the conditions of the present process from about 0.1 mil (1 mil=one one-thousandth of an inch) to about 1 mil per hour.

A preferred concentration range for each of the metal ion components of the present coating bath is as follows: nickel ions, about 0.5 to about 0.8 moles per gallon; cobalt ions, about 0.15 to about 0.3 moles per gallon; and thallium ions, about $8\times10^{-5}$ to about $4\times10^{-5}$ moles per gallon. A range of about 0.3 to about 0.8 moles per gallon of borohydride reducing agent is preferred. The ratio of nickel, cobalt, boron and thallium in the present coatings can be adjusted by varying the relative amounts of the metal salt components and borohydride in the coating bath.

Under normal usage conditions of the coating baths in accordance with the present invention, thallium ions and borohydride reducing agent are added to the coating bath hourly in amount equivalent to their usage in preparation of the bath initially. The need to replenish the present coating baths with thallium and borohydride depends on the ratio of coating bath volume to the surface area being coated. Thus replenishment of thallium and borohydride to the present coating bath would not be required where but small surface areas are being treated. One gallon of bath prepared in accordance with the preferred embodiment of the present invention will coat approximately 700 square inches to a thickness of 1 mil where the bath is replenished in accordance with the above description with thallium and borohydride ion as those components are depleted from solution.

The pH of the coating bath will tend to drop during the coating process and should be checked periodically to assure that it is within the preferred pH range of about 12 to about 14. It has been found that any problems with pH maintenance throughout the use of a coating bath can be minimized simply by using a highly alkaline (concentrated sodium hydroxide) solution of borohydride to replenish the borohydride content of the bath as required. The coating deposition rate from the present electroless coating bath is about 0.1 to about 1 mil per hour and is dependent on bath temperature, pH, and metal ion concentration. The deposition rate on most metal substrates from freshly prepared coating baths at a preferred temperature of about 185 to about 195° F. is approximately 1 mil per hour.

The practical aspects carrying out electroless coating processes are well known in the art. Such processes are disclosed generally in U.S. Pat. Nos. 3,338,726 issued to Berzins on Aug. 19, 1967; 3,096,182 issued to Berzins on Jul. 2, 1963; 3,045,334 issued to Berzins on Oct. 1, 1958; 3,378,400 issued to Sickles on Apr. 16, 1968; and 2,658,841 issued to Gutzeit and Krieg on Nov. 10, 1953; the disclosures of which are hereby incorporated by reference.

The electroless coating bath of this invention can also be used for electrolytic deposition of coatings comprising about 67.5 to about 96.5 weight percent nickel, about 2 to about 15 percent weight cobalt, about 0.5 to about 10 weight percent boron and about 1 to about 8 percent thallium. The bath is prepared as described above and is used at ambient temperatures as the electrolyte in an electrolytic cell using, for example, a nickel anode and the substrate as the cathode. The cell is connected to a 12-volt DC power source and current flow through the cell is adjusted to, for example, about 50 amps per square foot, and current flow is maintained until the metal alloy is deposited on the substrate cathode to the desired thickness.

The preferred electroless metal alloy coatings of the present invention exhibit unprecedented hardness and concomitant wear resistance. They are highly ductile allowing the coating to flex with the substrate while maintaining a strong bond to the coated material. The present coatings are nonporous and exhibit remarkably enhanced corrosion resistance over nickel boron coatings previously known in the art.

The electroless metal alloy coatings of this invention present a wear and corrosion resistant surface comprising hard, amorphous nodular deposits of metal alloy. Hardness of the present coatings can be increased by heat treatment of the coated articles. Heat treatment is accomplished at a temperature of about 375 to about 750° F. for a period of about one to about 24 hours. Shorter times, about one to two hours, is preferred for the higher temperatures of between about 550–750° F. while longer heat treatment times have been shown to be advantageous at the lower temperature ranges of between about 375 to about 450° F.

Figure 2:
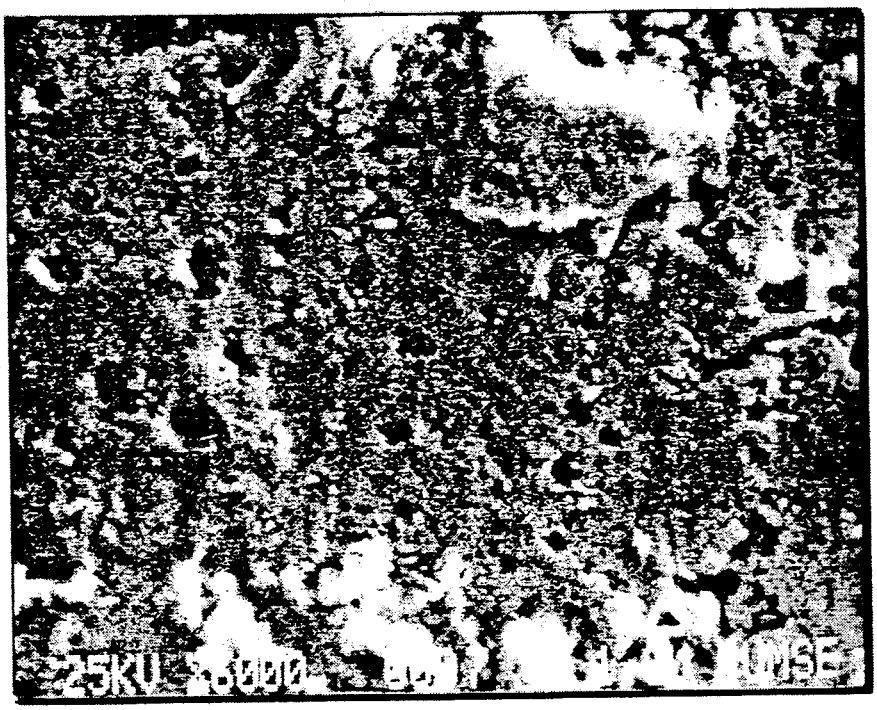
FIG. 2 is an electron photomicrograph of the substrate interface side of the coating shown in FIG. 1.

X-ray analysis of the metal alloy coatings prepared in accordance with the preferred embodiments show that the hard, amorphous nodular deposits lie in a somewhat softer metal alloy matrix. See FIGS. 1 and 2. X-ray analysis (using a JEOL scanning electron microscope with a computerized EDAX analyzer) also revealed that the coating is heterogenous in thickness cross-section having a metal concentration gradient with higher cobalt concentrations at the interface of the coating and the surface of the substrate. The corrosion and wear resistant surface (the hard nodular deposits) of several coatings prepared in accordance with preferred embodiments of this invention were shown to comprise about 86 to about 92 percent nickel, about one to about five percent weight cobalt, about one to about eight percent boron, and about one to about five percent thallium. Analysis of those same coatings at the interface of the coating and the surface of the substrate was shown to have high cobalt concentrations (as high as about 95 weight percent cobalt).

The nodular deposits making up the wear and corrosion resistant surface presented by the present coatings are believed to be amorphous as deposited from the electroless coating bath. With heat treatment in accordance with the above description, X-ray data showed crystalline domains of metal borides selected from nickel boride and cobalt boride dispersed in the amorphous metal alloy matrix. The formation of hard crystalline domains of metal borides within the nodular structures is believed to be responsible for the high hardness levels which have been measured for the present heat-treated coatings. Heat-treated coatings in accordance with the present invention have been found to have a Knoop hardness value of between about 1230 and about 1300. These values are more than 20 percent higher than the best hardness values reported previously for nickel boron electroless coatings.

Because of the heterogeneity in thickness of cross-section observed for preferred coatings in accordance with the present invention, the actual bulk weight percent content of any of the four components in any given coating depends to a some extent on coating thickness. The surface-presented nodules are high nickel-low cobalt content while the softer alloy matrix for the nodules formed immediately at the surface of the substrate (i.e., the first deposited component of the present coatings) is of high cobalt and low nickel content. Thus the thinner deposits of the present coating have a higher overall weight percent cobalt. Thicker coatings in accordance with the present invention have a greater percentage of their thickness in the form of the amorphous nodules and, therefore have lower overall bulk weight percent cobalt content.

The present coatings have a wide range of applications which will be recognized by those skilled in the art. They have particular utility for coating surfaces of articles which under normal use are subjected to highly abrasive, rubbing, or sliding conditions under high temperatures/pressures. Such high wear conditions are found at many points in construction of tools, internal combustion engines including gas turbine engines, transmissions and in a wide variety of heavy equipment construction applications.

The following examples provide details of bath compositions, process conditions, and coating compositions and properties representative of the present invention. The examples are illustrative of the invention and are not in any way to be taken as limiting the scope thereof.

EXAMPLE 1

A five (5) gallon batch unit of coating bath was prepared as follows. Nickel chloride (0.9 pounds, 3.15 moles) was combined with sodium tartrate (2.5 pounds, 4.93 moles) in about two gallons of distilled water having a resistance of approximately ten megohms. To that solution was added 0.25 pounds of cobalt chloride (0.85 mole) and 3.0 pounds or reagent grade (99.5% pure) ethylene diamine (17.4 moles), 3.5 pounds of reagent grade sodium hydroxide (39.7 moles) and 1.0 pound of concentrated ammonium hydroxide solution. The volume of the resulting mixture (pH about 13.5) was adjusted to five gallons by the addition of distilled water, and the solution was heated to 180° F. and filtered into electroless plating tank capable of continuous filtration, heating and agitation of the bath composition. The temperature of the bath was raised to about 185° F.

Two strips of steel 15 mil thick by ½ inch in width were degreased and prepared for immersion in the coating bath by successive anodic alkaline oxidation followed by acid pickling.

To the heated coating bath was added 0.023 pounds of sodium borohydride (0.11 moles) and 0.20 grams of thallium sulfate ($4\times10^{-4}$ mole). The coating solution was agitated for about 3 minutes prior to the immersion of the prepared steel strips into the bath. A third steel strip was immersed in the bath without pretreatment.

The steel plates were removed from the coating bath after about 1.5 hours. Each had an electroless coating in accordance with the present invention about 1 mil (1/1,000th of an inch) thick. Electron microscopic examination (×6000) of the surface on the coated steel strips showed the surface revealed nodular metal alloy deposits having a cauliflower-like appearance. See FIG. 1. Using scanning electron microscopy (SEM) the nodular deposits at their outermost surface were found to have the following composition: about 90 weight percent nickel, about 5 weight percent boron, about 2 weight percent cobalt, and about 3 weight percent thallium.

The third steel strip which did not have its surface properly prepared for optimum adhesion of the electroless coating was bent and creased so that the coating was purposely fractured, and a small sample separated from the steel substrate surface. Analysis of the substrate interface side of the coating deposited on the steel surface revealed that it contained in excess of 95 weight percent cobalt. (See FIG. 2) Interestingly, analysis of apparent holes in the interface side of the coating showed lower cobalt levels and much higher nickel levels. Similarly x-ray analysis of the "valleys" between the nodules on the outer surface of the coating showed nickel levels lower than those in the upper surfaces of the nodules and higher cobalt levels. These results indicate that the coating prepared in accordance with preferred embodiments of the present invention are heterogeneous in thickness cross-section having a higher cobalt concentration at the interface of the coating and the substrate surface. In sum, it appears that the high nickel alloy nodules at the outer surface of the coating are imbedded in a softer high cobalt alloy matrix deposited during the early stages of the electroless coating process.

A coated steel strip was tested for surface hardness using a Knoop hardness measuring device (KH 100) and found to exhibit a Knoop hardness of 1100 which surpasses that of commercial grade hard chrome. Following heat treatment at 725° F. for 90 minutes the same surface was found to have a Knoop hardness of approximately 1240. Electroless coatings deposited from a bath prepared in accordance with the example have also shown exceptional corrosion resistance under laboratory test conditions: ASTB B117 Salt Spray-1200 hours.

EXAMPLE 2

The same procedure was followed as in Example 1 except for variation of the relative amounts of the bath constituents: nickel chloride, 0.9 pounds (3.12 moles); cobalt chloride, 0.3 pounds (1.05 moles); thallium I sulfate, 0.05 gram ($1\times10^{-4}$ mole); sodium borhydride, 0.0275 pounds (0.33 moles); ethylene diamine, 3.0 pounds (17.4 moles); sodium hydroxide, 6.0 pounds (68 moles); concentrated ammonium hydroxide, 0.75 pounds; sodium tartrate, 2.5 pounds (5 moles). X-ray analysis of the nodules at the wear and corrosion resistant surface of the coated steel strips showed the nodules to contain about 88 weight percent nickel, about 3 weight percent cobalt, about 8 weight percent boron, and about 1 weight percent thallium in an alloy matrix or layer containing cobalt in excess of about 95 weight percent. Several coated substrates were heat treated at 725° F. for 90 minutes and others were treated at 550° F. for 12 hours. The coatings on the heat treated substrates were found to have a hardness of approximately 1300 Knoop.

EXAMPLE 3

The same procedure was followed as in Example 1 except that the coating bath constituents were utilized in the following amounts: nickel chloride, 1 pound (3.5 moles); cobalt chloride, 0.375 pounds (1.3 moles); thallium I sulfate, 0.25 gram ($5\times10^{-4}$ moles); sodium borohydride, 0.0175 pounds (0.21 moles); ethylene diamine, 2.5 pounds (14.5 moles); sodium hydroxide, 5 pounds (57 moles); ammonium hydroxide, 0.75 pounds; sodium tartrate, 4 pounds (7.9 moles). X-ray analysis of the surface nodules presented by the deposited electroless coating showed them to contain about 90 weight percent nickel, about 4 weight percent cobalt, about 1 weight percent boron, and about 5 weight percent thallium. Several coated steel plates were heat treated at 725° F. for 90 minutes while others were treated at 550° F. for 12 hours. Hardness testing of the coated articles both before and after heat treatment showed a hardness of approximately 1,000 Knoop. While that value is somewhat less than those measured for the coatings prepared in Examples 1 and 2 above, it is nonetheless comparable to hard chrome and much more corrosion resistant. It appears that the present coating having a higher ratio of thallium to boron and a marginally higher cobalt content in the surface nodules would find particular application where corrosion resistance is more important than hardness value.

EXAMPLE 4

An electroless coating bath having a volume of one gallon was prepared as follows: 81 grams of nickel chloride (0.625 mole); 34 grams of cobalt chloride (0.26 moles), 227 grams of ethylene diamine (2.9 moles), and 136 grams of sodium tartrate (0.59 moles) were combined in about 3 quarts of distilled/deionized water. The pH of the solution was adjusted to about 13.5 by the addition of 181 grams of sodium hydroxide (4.5 moles) and 68 grams of concentrated ammonium hydroxide solution. The volume of the resulting mixture was adjusted to about one gallon by the addition of distilled water. The coating bath mixture was then heated to approximately 190° F. and filtered into an electroless heating bath tank having means for continuous filtration, heating and agitating of the bath mixture. Two case hardened steel pins measuring about nine inches in length and 2.5 inches in diameter were degreased, and subjected to anodic alkaline and acid cleaning treatments and washed thoroughly with distilled water.

Immediately before immersing the pretreated steel bars into the coating bath, 0.04 grams of thallium I sulfate ($8\times10^{-5}$ moles) and 2 grams of sodium borohydride (0.053 moles) were added to the hot, stirred electroless coating bath. After about 5 minutes the substrate steel bars were lowered into and suspended in the electroless coating bath. Hydrogen evolution at the surface of the bars was noted immediately. After about 1 hour an additional 0.4 grams of thallium sulfate and 10 milliliters of a sodium borohydride solution (0.83 pounds sodium borohydride in 1 gallon of water containing also about 400 grams of sodium hydroxide). After 2 hours the coated substrates were removed from the coating bath, washed and scanned by x-ray for surface nodule elemental content and found to have about 90 weight percent nickel, about 2 weight percent cobalt, about 5 weight percent boron, and about 3 weight percent thallium The coating exhibits exceptional hardness and corrosion and wear resistance.

EXAMPLE 5

The coating bath of Example 4 is used to apply an electroless metal strike before and after application of nickel plates to prepared metal substrates. It was found that deposition of a thin metal strike either before or after the nickel electroplating process significantly decreased the porosity, and therefore enhanced the corrosion resistance, of the plated substrates. An electroless nickel alloy strike utilizing the coating baths of the present invention is particularly effective to improve corrosion resistance of electroplates when it is applied to the electroplate as an overcoat.

While there have been described what are at present considered to be certain preferred embodiments of this invention, it will be understood that various modifications may be made therein, and it is intended to cover in the appended claims all such modification as fall within the true spirit and scope of the invention.

What is claimed is:

1. A coating bath for providing a hard, wear and corrosion resistant, ductile coating on a substrate, said bath having a pH of about 12 to about 14 and comprising (1) the following metal ions, the amounts indicated expressed as moles per gallon of coating bath:
nickel ions, about 0.4 to about 0.9;
cobalt ions, about 0.1 to about 0.4; and
thallium ions, about $4\times10^{-5}$ to about $8\times10^{-4}$;

(2) chemical means for complexing said ions to inhibit their precipitation from the basic coating bath said chemical means comprising a metal ion complexing compound selected from the water soluble salts of tartaric acid, citric acid, oxalic acid, ethylenediamine, diethylenetriamine, triethylenetriamine, ethylenediamine tetraacetic acid and ammonia;

(3) about 0.025 to about 0.1 moles of a borohydride reducing agent per gallon of coating bath.

2. The coating bath of claim 1 wherein the borohydride reducing agent is selected from the group consisting of sodium borohydride, potassium borohydride, sodium trimethoxyborohydride, and potassium trimethoxyborohydride.

3. The method of claim 1 wherein the chemical means for complexing the metal ions comprises a compound selected from the group consisting of ethylenediamine, water soluble salts of tartaric acid and ammonia.

4. The coating bath of claim 1 wherein from about 2 to about 8 moles of metal ion complexing compound per gallon of coating bath.

5. The coating bath of claim 1 wherein the metal ions are present in the following respective amounts expressed as moles per gallon of coating bath:
nickel ions, about 0.05 to about 0.8;
cobalt ions, about 0.15 to about 0.3; and
thallium ions, about $4\times10^{-5}$ to about $8\times10^{-4}$.

* * * * *